US009512607B2

(12) United States Patent
Braun et al.

(10) Patent No.: US 9,512,607 B2
(45) Date of Patent: Dec. 6, 2016

(54) CATCH BASIN BAFFLE INSERT

(71) Applicant: CB SHIELD INC., Oakville (CA)

(72) Inventors: Stephen Braun, Oakville (CA); Hal Stratford, Brantford (CA)

(73) Assignee: CB Shield Inc., Toronto (CA)

( * ) Notice: Subject to any disclaimer, the term of this patent is extended or adjusted under 35 U.S.C. 154(b) by 141 days.

(21) Appl. No.: 14/587,180

(22) Filed: Dec. 31, 2014

(65) Prior Publication Data

US 2016/0186422 A1 Jun. 30, 2016

(51) Int. Cl.
*E03F 5/04* (2006.01)
*E03F 1/00* (2006.01)

(52) U.S. Cl.
CPC ..... *E03F 1/00* (2013.01); *E03F 5/0403* (2013.01); *E03F 5/0404* (2013.01)

(58) Field of Classification Search
CPC ..... E03F 1/00; E03F 5/0401; E03F 5/0403; E03F 5/0404; E03F 5/041; E03F 5/14
USPC ..... 210/747.2, 747.3, 801, 163, 164, 170.03,210/305, 307, 532.1; 404/4, 5
See application file for complete search history.

(56) References Cited

U.S. PATENT DOCUMENTS

| | | | | |
|---|---|---|---|---|
| 5,405,539 | A * | 4/1995 | Schneider | E03F 5/0404 210/163 |
| 5,788,410 | A | 8/1998 | Stucks | |
| 6,062,767 | A | 5/2000 | Kizhnerman et al. | |
| 6,908,549 | B2 | 6/2005 | Middleton et al. | |
| 8,663,466 | B2 | 3/2014 | Braunwarth et al. | |
| 8,715,507 | B2 | 5/2014 | Gulliver et al. | |
| 2004/0226869 | A1* | 11/2004 | McClure | E03F 5/0404 210/163 |
| 2004/0251185 | A1* | 12/2004 | Pitt | E03F 5/0404 210/163 |
| 2005/0051499 | A1* | 3/2005 | Nino | E03F 5/0404 210/747.3 |
| 2005/0072738 | A1* | 4/2005 | Weir | E03F 5/0404 210/163 |
| 2007/0187310 | A1* | 8/2007 | Weir | E03F 5/0404 210/163 |

* cited by examiner

*Primary Examiner* — Christopher Upton

(57) ABSTRACT

A baffle insert is disclosed for a catch basin having a sump, a plurality of walls defining a passage to the sump, and an outlet. The insert comprises a ramp for positioning in the passage to partially occlude the passage and direct inflowing fluid downwardly and toward a wall of the basin. A grate is positioned below the ramp to intercept fluid falling from the ramp and direct it toward the basin outlet. The grate forms a barrier above the sump and has a plurality of apertures for permitting fluid to communicate with the sump. The ramp and the grate mounted to an post that rests on the bottom of the sump. The post is extendible to adjust the heights of the ramp and the grate above the sump.

21 Claims, 9 Drawing Sheets

CATCH BASIN BAFFLE INSERT

FIELD

The present invention relates to catch basins, and in particular, to devices and methods for controlling flow and quality of surface runoff water in catch basins.

BACKGROUND

Storm sewer systems typically include catch basins to collect surface runoff water. Catch basins may be shallow below-ground wells or pits with inlets at surface level, for example, in streets or in sidewalks, and with outlets draining into larger storm sewers, streams, or other bodies of water.

Catch basins may collect surface runoff water, such as precipitation, melt water and waste water. Inflowing water may carry entrained sediment which may include dirt, sand, litter, or other waste. Catch basins are often designed with a sump in which water pools to promote settling of sediment so that sediment may be removed from the basin and disposed of, rather than being carried downstream by water flowing out of the catch basin. Water may pool in the sump and remain substantially undisturbed for extended periods (e.g. hours or days) when surface runoff is slow or absent.

Events such as storms, spring melt or the like may periodically cause water to flow into catch basins at relatively high rates. High flow rate or fast-flowing water may agitate sump pools in conventional catch basins, causing accumulated sediment to mix with and be carried away by water flowing out of the sump. Such conditions may limit the effectiveness of catch basins for capturing and removing sediment and may result in sediment being deposited, for example, on streets, in streams, or the like.

SUMMARY

Disclosed herein is an example baffle insert for a catch basin with a sump, a plurality of walls defining a passage to the sump, and an outlet, the baffle insert comprising: a downwardly-sloping ramp for positioning in the passage to partially occlude the passage with a lower edge of the ramp proximate a first one of the walls and direct inflowing fluid toward the first wall; a grate positioned below the ramp to intercept fluid falling from the ramp and direct the falling fluid toward the outlet, the grate having a plurality of apertures for permitting fluid to communicate with the sump therethrough; the ramp and the grate mounted to a post for supporting the ramp and the grate by resting the post on the bottom of the sump, the post extendible to adjust the heights of the ramp and the grate above the sump.

Also disclosed herein is an insert for a catch basin having a sump, a passage to the sump, and an outlet, the insert comprising: a downwardly sloping ramp; a grate below the ramp, the grate having at least one aperture therethrough; an extendible post for resting on a bottom wall of the catch basin to support the ramp and the grate at a desired height above the sump such that inflowing fluid is intercepted by the ramp, and fluid falling from the ramp lands on the grate and is directed toward the outlet, wherein the fluid is decelerated to promote settling of sediment and the grate permits communication of fluid into the sump through the apertures.

Also disclosed herein is a baffle insert for a catch basin with a sump, a plurality of walls defining a passage to the sump, and an outlet, the baffle insert comprising: a ramp in the passage below an inlet of the catch basin, the ramp positioned to catch fluid flowing through the inlet and direct the fluid downwardly and toward a first wall of the catch basin; a grate below the ramp in the passage, the grate abutting the first wall and positioned to catch fluid falling from the ramp and direct the fluid toward the outlet, the grate having a plurality of apertures for permitting fluid to communicate with the sump therethrough; a post resting on the bottom of the sump, the post supporting the ramp and the grate.

Also disclosed herein is a method of controlling fluid flow in a catch basin, the method comprising: installing an insert having a ramp and a grate in a catch basin, the installing comprising adjusting a height of a support post to position the grate at a desired height above a sump of the catch basin; directing inflowing fluid toward a wall of the catch basin with the ramp, thereby decelerating the fluid; intercepting fluid falling from the ramp and diverting the fluid toward an outlet of the catch basin with a grate to further decelerate the fluid; directing fluid through apertures in the grate into a sump of the catch basin for settling of sediment in the sump.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures, which illustrate by way of example only, embodiments of this invention.

DETAILED DESCRIPTION

Figure 1:
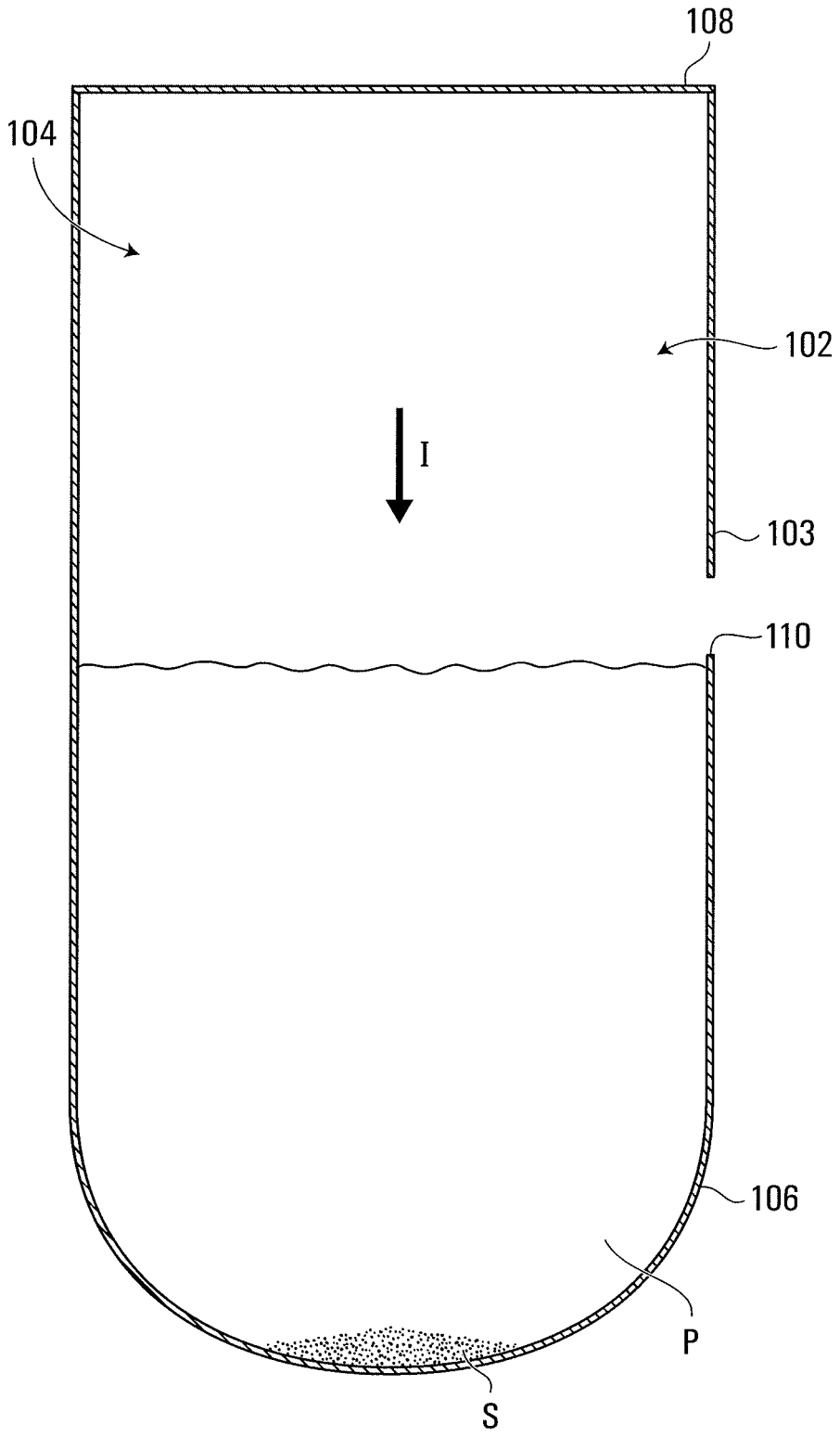
FIG. 1 (Prior Art)
FIG. 1 is a diagram of fluid flow in a catch basin.

FIG. 1 depicts a typical catch basin 102. Catch basin 102 has a plurality of walls 103 extending downwardly and defining a sump 106 and an inlet passage 104 leading to sump 106. Catch basin 102 may be covered by a grate 108 with slots or other apertures. Grate 108 may be positioned at or just below ground surface level and catch basin 102 may have walls 103 which extend below ground to define a reservoir. Thus, catch basin 102 is configured to collect water or other fluid such as surface runoff. Fluid may flow into catch basin 102 through apertures in grate 108, accumulate and ultimately exit catch basin 102 through an invert or outlet 110, which may be connected to a storm sewer system. As used herein, the term "sump" refers to the portion of the catch basin 102 that lies below the outlet 110.

The depicted catch basin 102 is approximately 60 cm in length and width and has a circular outlet approximately 25 cm in diameter. However, in other embodiments, the dimensions of catch basin may differ.

Inflowing fluid I, such as runoff from streets and the like may flow into catch basin 102 and fall into sump 106. The fluid I may carry dirt and sediment. As used herein, unless otherwise specified, references to "fluid" or "fluid flow" also include any entrained dirt or sediment. As will be apparent, as fluid I falls, it may accelerate due to gravity. Accordingly, pool P may be disturbed by the inflowing fluid I.

Under typical conditions, fluid I flows into catch basin 102 intermittently or at a relatively low rate. Fluid accumulates in pool P in sump 106 until the level of pool P reaches outlet 110. Thereafter, further fluid flowing into catch basin 102 causes fluid to be displaced out of catch basin 102 through outlet 110, for example, into a storm sewer or other drainage system.

Fluid generally resides in pool P in sump 106 until it is displaced through outlet 110 or until it evaporates. Thus, fluid typically resides in P for a period of time which may be proportional to the rate at which fluid flows into catch basin. When fluid I flows slowly or intermittently, pool P may become relatively still, which may allow sediment S to settle to the bottom of sump 106, rather than being carried with outflowing fluid. Accumulated sediment may periodically be removed (e.g. manually or using a machine) and disposed of.

Events such as downpours or seasonal melt may cause inflowing fluid I to rush into catch basin 102 at a high velocity or flow rate. As is well known to skilled persons, fast-flowing fluid can more easily entrain suspended particles, compared to slower-moving fluid. Accordingly, fluid rushing into catch basin 102 is likely to carry larger quantities of sediment, as compared to normal, lower-speed flows. In addition, in some cases, the flow of incoming fluid may be sufficient to bypass sump 106. That is, incoming fluid may rush directly out through outlet 110, rather than residing in sump 106 for a significant period of time. Accordingly, incoming sediment may not have an opportunity to settle and may simply be carried out of catch basin 102. Moreover, incoming fluid at high flow rate or velocity may agitate pool P and promote mixing of previously-settled sediment S, which may ultimately lead to sediment being carried out of catch basin 102.

Accordingly, deceleration of fluid flow and separation of fast-flowing fluid from sump 106 may tend to promote settling and retention of sediment in sump 106, allowing for planned removal and disposal thereof.

Figure 2:
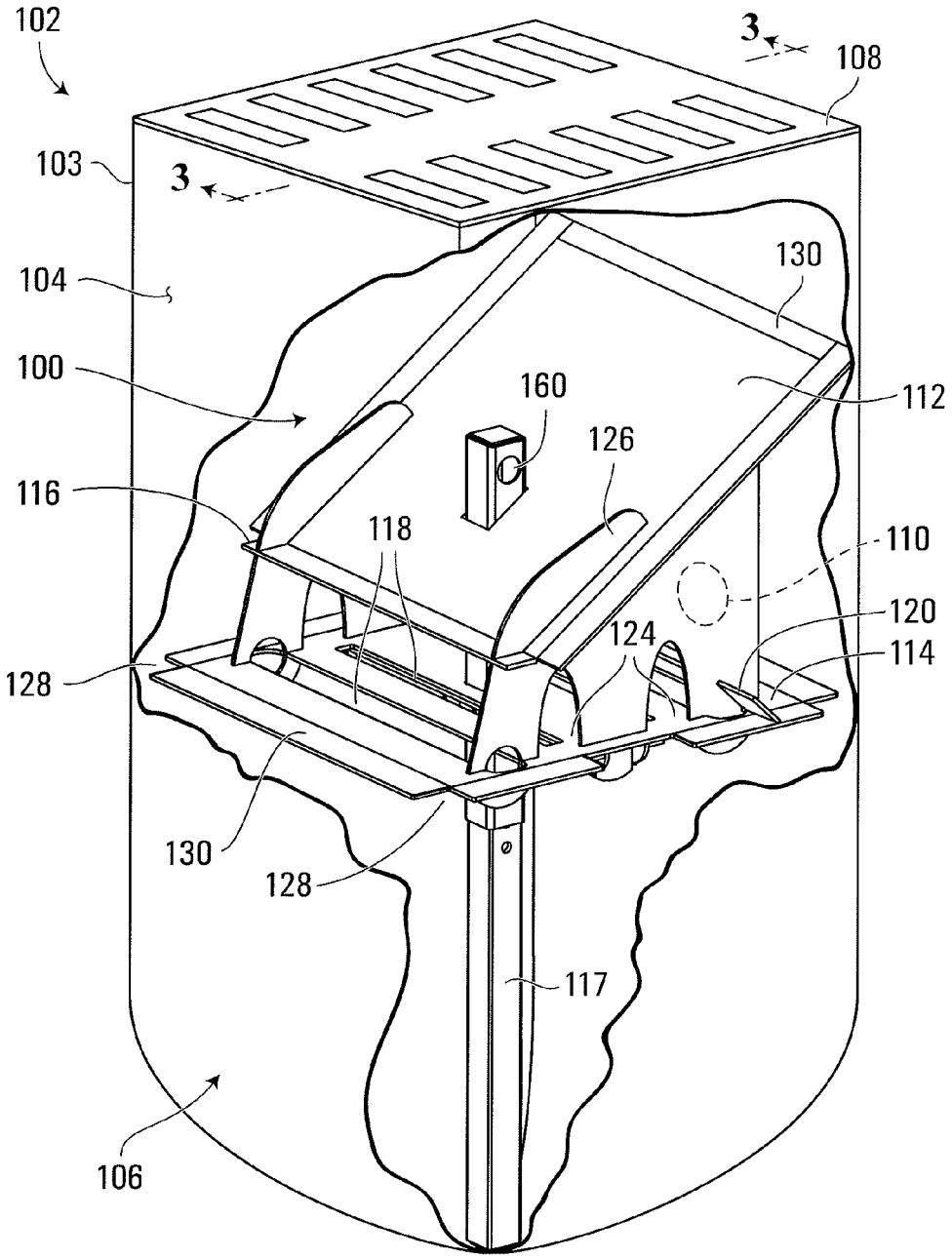
FIG. 2 is a perspective view of an insert in the catch basin of FIG. 1.

FIG. 2 depicts a baffle insert 100 installed in catch basin 102. Baffle insert 100 partially occludes passage 104 of catch basin 102. Some or all fluid flowing into catch basin 102 may fall on insert 100, rather than falling directly into sump 106. Insert 100 directs such inflowing fluid through a tortuous flow path to decelerate the flow and aid settling and retention of sediment.

Insert 100 includes a ramp 112 and a grate 114. Ramp 112 and grate 114 are supported by a post 117, which rests on the bottom of sump 106.

Ramp 112 may be a solid plate, which may, for example, be formed from fiberglass, metal, concrete, wood or plastic. Ramp 112 slopes downwardly and toward a wall 103 of catch basin 102 opposite outlet 110. Ramp 112 catches fluid flowing into catch basin 102 and directs the fluid downwardly toward the lower edge of the ramp and toward the wall. As depicted, ramp 112 is angled at approximately 35 degrees to the horizontal. However, in other embodiments, ramp 112 may be positioned at a different angle, preferably between 5 and 60 degrees to horizontal. As depicted, ramp 112 has a flat and generally smooth surface. However, in some embodiments, ramp 112 may have a roughened or perforated surface to increase friction, and thus promote deceleration of fluid flowing over ramp 112.

As used herein, the "front" edges of ramp 112 and grate 114 are the edges farthest away from outlet 110 of catch basin 102 when viewed from above. The "rear" edges are those closest to outlet 110 when viewed from above. The front edge of ramp 112 is also its bottom edge. Similarly, the "front" wall of catch basin 102 is the wall opposite outlet 110 and is referred to individually as wall 103*a* (see FIGS. 3-4). The rear wall, referred to as wall 103*d*, is the wall containing outlet 110, and the side walls are referred to as 103*b* and 103*c*.

Figure 3:
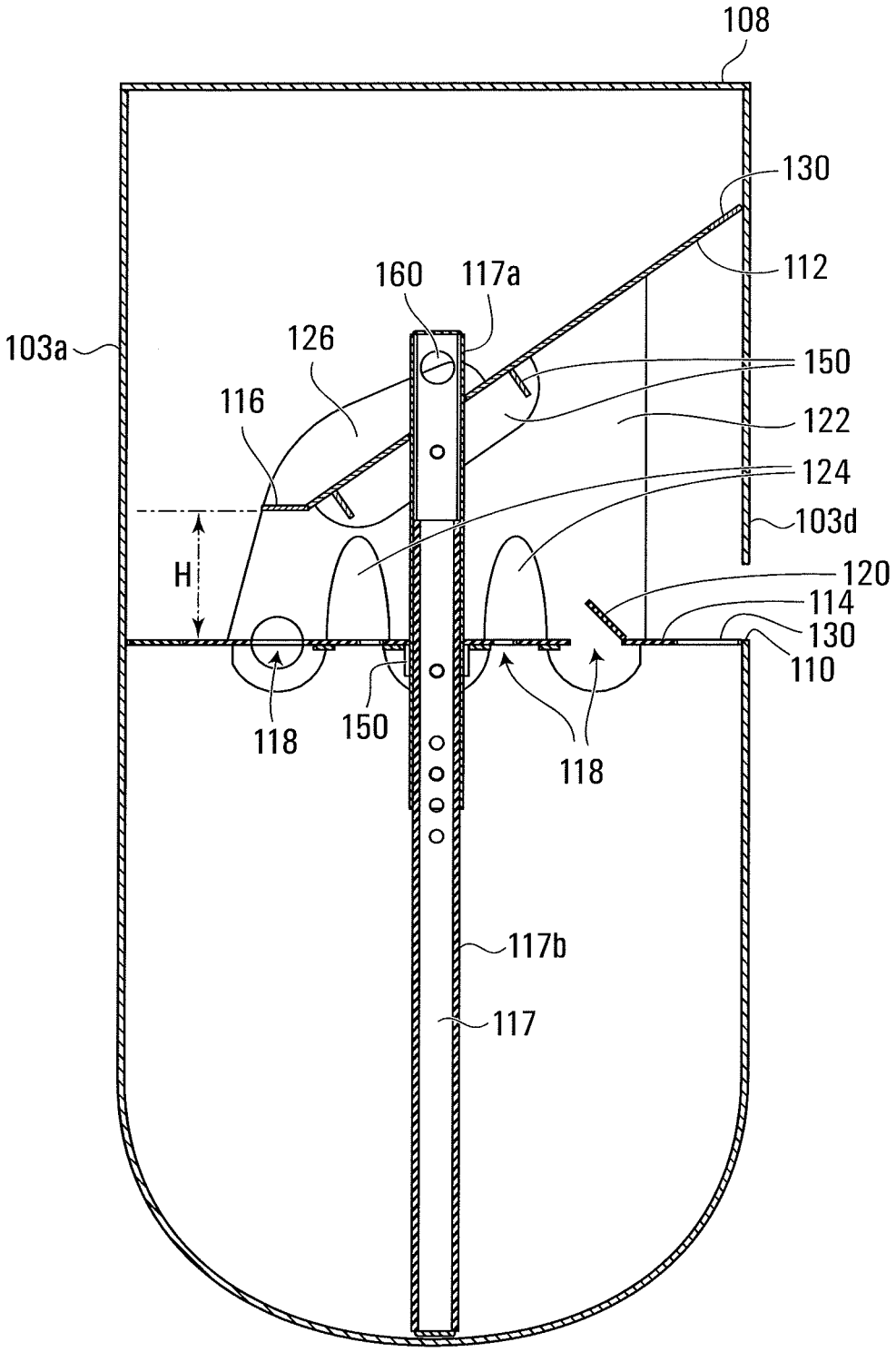
FIG. 3 is a cross-sectional view of the insert of FIG. 2.

As is best depicted in FIGS. 2-3, ramp 112 has a lip 116 at its front edge. Lip 116 is angled upwardly relative to ramp 112. As depicted, lip 116 extends horizontally. In other embodiments, lip 116 could extend at a different angle, preferably 0-90 degrees upwardly relative to ramp 112. As depicted, lip 116 may be formed integrally with ramp 112, or may be formed separately and attached to ramp 112. In still other embodiments, lip 116 may be omitted.

Grate 114 is positioned below ramp 112, abutting front wall 103*a*, to intercept fluid falling from ramp 112 and direct it away from front wall 103*a*. Grate 114 is vertically aligned with the lower edge of outlet 110. Accordingly, grate 114 is vertically spaced apart from the lower edge of ramp 112 to leave a gap through which fluid can flow. As depicted, ramp 112 and grate 114 are spaced apart so that the gap has a minimum height h of approximately 12.5 cm and a minimum cross-sectional area of approximately 750 $cm^2$ (corresponding to the minimum height of 12.5 cm, multiplied by the basin width of 60 cm). The minimum height is set to provide a minimum cross-sectional area greater than the area of outlet 110, so that the maximum fluid flow rate between ramp 112 and grate 114 is at least as great as the maximum flow rate through outlet 110. In other embodiments, for example, for basins with smaller or larger outlets, the minimum height h may be between 10 and 45 cm. As will be apparent, if height h is larger, a greater amount of fluid may be able to flow between ramp 112 and grate 114.

As depicted, grate 114 is oriented generally horizontally so as to be parallel to the surface of pool P in sump 106. As used herein, "horizontal" means perpendicular to the pull of gravity. However, grate 114 may alternatively be positioned to slope slightly towards wall 103*d* or away from wall 103*d*. Preferably, grate 114 is oriented at an angle of 30 degrees or less to the horizontal.

Grate 114 may be formed for example from fiberglass, metal, wood, concrete or plastic. Grate 114 has a plurality of openings 118. As will become apparent, grate 114 is constructed to define a barrier above sump 106 so that fast-flowing fluid may flow across grate 114 without flowing into or mixing fluid in sump 106, but to permit communication of small or slow incoming flows with sump 106. Accordingly, grate 114 has a plurality of relatively small, spaced apart openings 118 through which small flows can enter sump 106.

As depicted, openings 118 are elongated slots extending across substantially the entire width of grate 114. Openings 118 are generally oriented parallel to the front edge of grate 114. As will be described in further detail below, this orientation of openings 118 is generally transverse to a primary flow path of fluid flowing across grate 114. As depicted, openings 118 include two large openings 118*a* and two smaller openings 118*b* (collectively referred to as openings 118). Large openings 118*a* are approximately 50 mm across in the primary direction of fluid flow and small openings 118*b* are approximately 25 mm across in the primary direction of fluid flow. The openings 118 are spaced approximately 50 mm apart from one another in the direction of fluid flow. In this configuration, openings 118 occupy approximately 25% of the area of grate 114.

In other embodiments, openings 118 may be configured differently. For example, openings may be provided in any combination of sizes between 25 mm and 50 mm in the primary flow direction. Moreover, openings 118 could be provided in different shapes, such as elongated curves, circles or ellipses. In addition, the total portion of grate 114 occupied by openings 118 could be more or less than depicted, preferably between 15% and 50% and most preferably between 20% and 30%.

Grate 114 may have a deflector 120 extending upwardly from its top surface and across its entire width proximate its rear edge. Dam 120 may interrupt or redirect fluid rushing across grate 114, which may decelerate the fluid or cause the fluid to traverse a longer flow path before reaching outlet 110.

Ramp 112 is attached to grate 114 by a pair of sidewalls 122. Sidewalls 122 may have one or more openings 124. Openings 124 may allow fluid flowing across grate 114 to reach the grate edges proximate walls 130*b*, 103*c*. As depicted, each sidewall has three openings 124 defined at the bottom of sidewalls 122, where they meet grate 114. In other embodiments, sidewalls 122 may have more or fewer openings, and may have openings in other locations. The lower edges of sidewalls 122 are received in corresponding mounting slots in grate 114 and the upper edges of sidewalls 122 are received through corresponding mounting slots in ramp 112. Sidewalls 122 extend through the mounting slots in ramp 112 to define guide walls 126. As will become apparent, guide walls 126 may serve to direct fluid flow on ramp 112.

Figure 4:
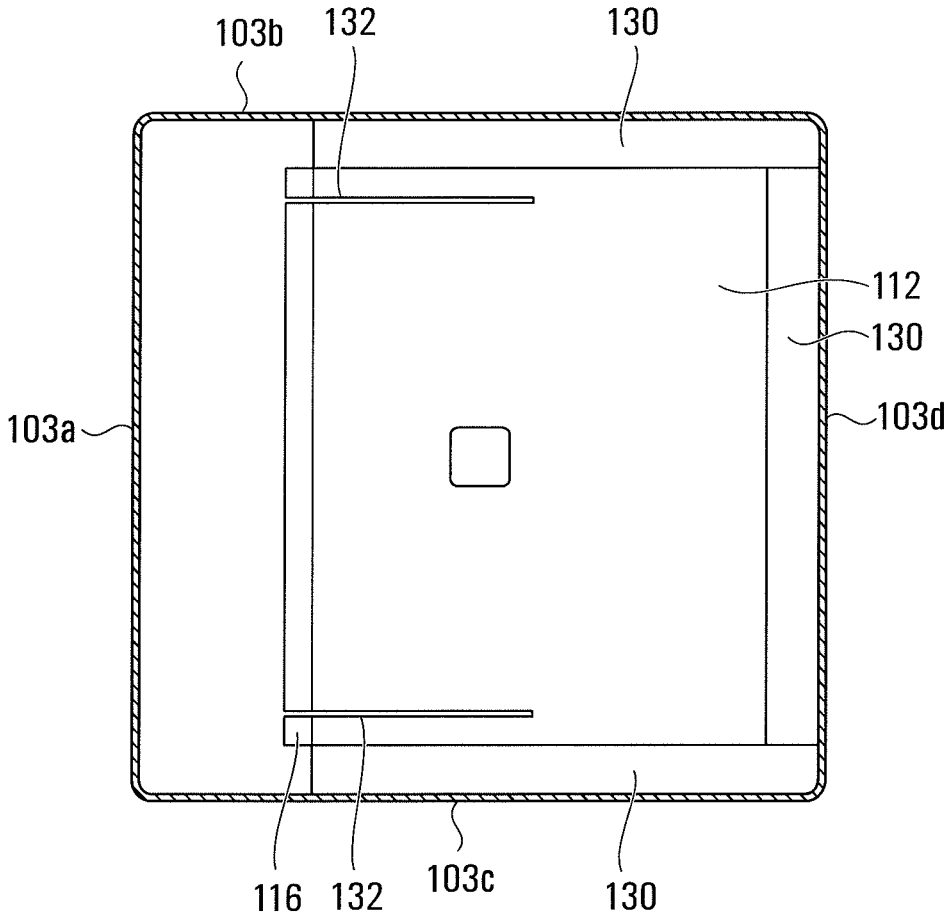
FIG. 4 is a top elevation view of a ramp of the insert of FIG. 2.
Figure 5:
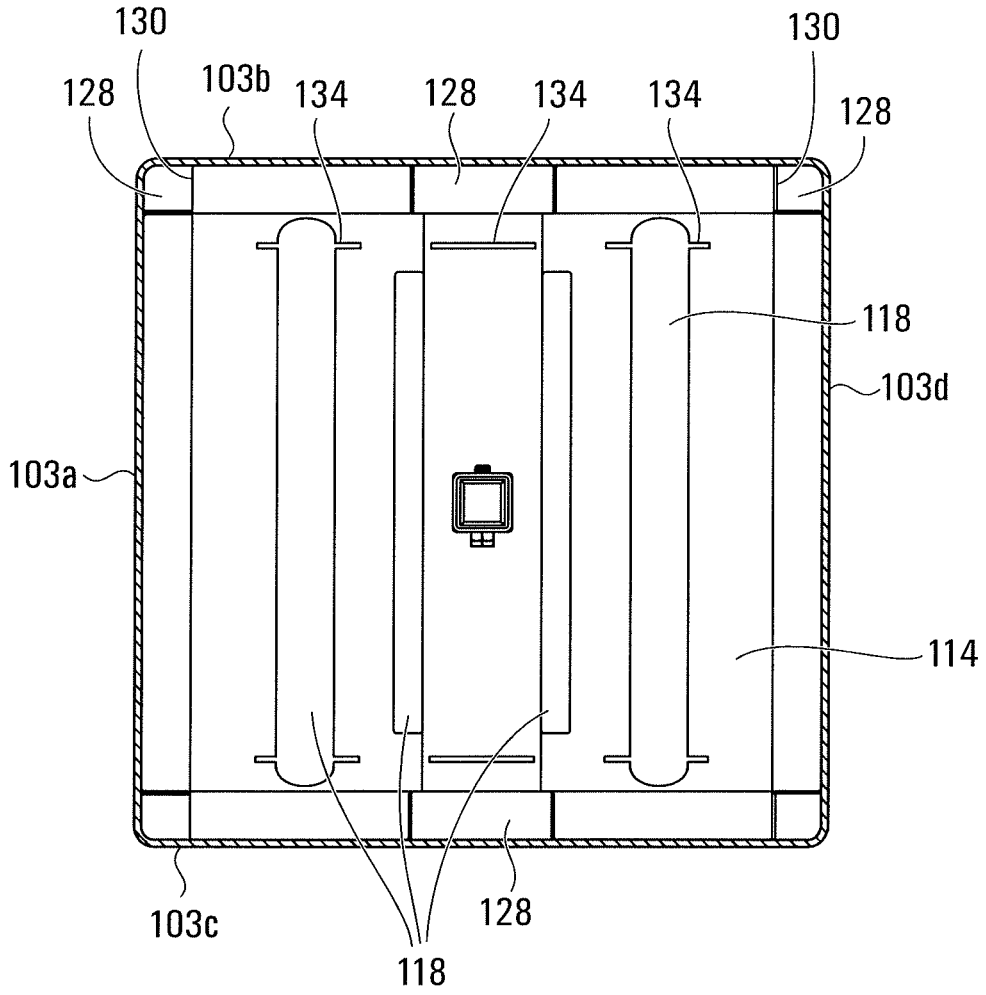
FIG. 5 is a top elevation view of a grate of the insert of FIG. 2.

FIGS. 4-5 are top views of ramp 112 and grate 114, respectively, in catch basin 102. For clarity, other portions of insert 100 are omitted from FIGS. 3-4.

Ramp 112 and grate 114 may have resilient flaps 130 extending from their edges towards the walls of catch basin 102. Flaps 130 engage the walls to support insert 100 and form a seal against the walls. Flaps 130 may be formed, for example, from rubber or resilient plastic.

Ramp 112 and grate 114 are sized so that, along with the associated flaps 130, they partially occlude inlet portion 104 of catch basin 102. Specifically, each of ramp 112 and grate 114 is slightly smaller in length and width than catch basin 102. Flaps 130 extend from the edges of ramp 112, grate 114 to engage the catch basin walls. Preferably, the width of each of ramp 112 and grate 114 is between 25 mm and 150 mm less than that of catch basin 102, to allow for approximately 12.5 mm to 75 mm clearance on each side. Similarly, the length of grate 114 is preferably between 25 mm and 150 mm less than that of catch basin 102 to allow for approximately 12.5 mm to 75 mm clearance on each side.

Flaps 130 extend from the sides of ramp 112 so that ramp 112 and its flaps 130 together span substantially the entire width of inlet portion 104 between catch basin side walls 103*b*, 103*c*. A flap 130 extends from the rear edge of ramp 112 and abuts the rear catch basin wall 103*d*, but a gap exists between the front edge of ramp 120 and the front catch basin wall 103*a*. The gap has at least the same area as outlet 110, to permit at least the same fluid flow rate.

Flaps 130 extend from each edge of grate 114 so that grate 114 and its flaps 130 span substantially the entire length and width of inlet section 104 of catch basin 102. Resilient flaps 130 extending from grate 114 define a plurality of notches 128 around grate 114. Notches 128 may allow for grate 114 to be passed into catch basin 102. For catch basin 102 may have structures for supporting grate 108 (not shown), and notches 128 may provide clearance for inserting insert 100 past such structures. Notches 128 may also permit fluid to flow therethrough. Ramp 112 has mounting slots 132 configured to receive corresponding upper tabs of sidewalls 122, which protrude through mounting slots 132 to define guide walls 126 (FIG. 2). Grate 114 has a plurality of mounting slots 134 configured to receive corresponding lower tabs of sidewalls 122.

Figure 6:
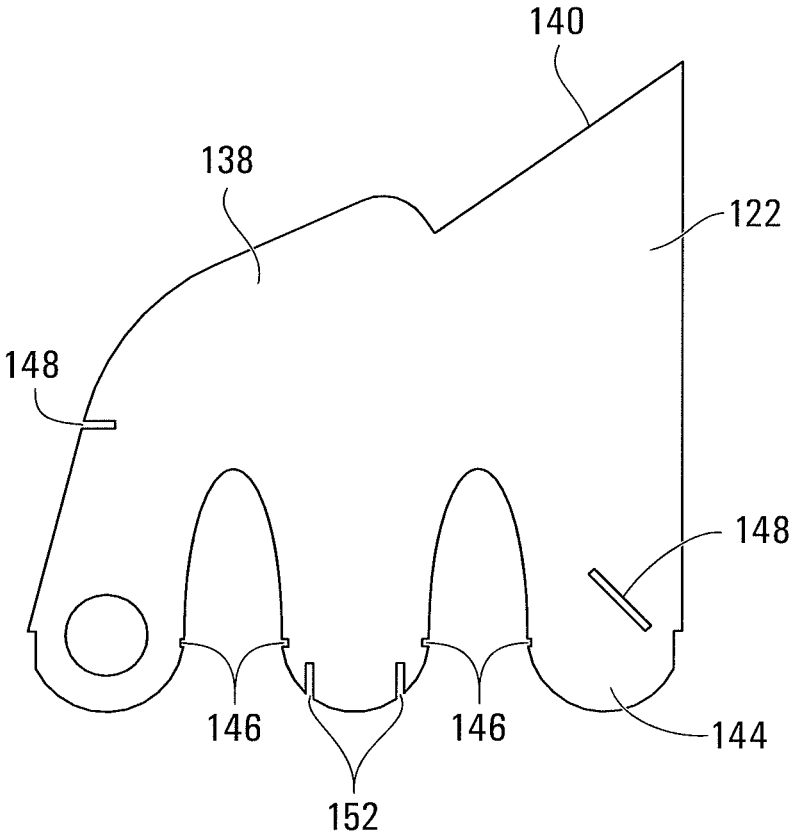
FIG. 6 is a side elevation view of a sidewall of the insert of FIG. 2.

FIG. 6 depicts a side elevation view of a sidewall 122. The opposite sidewall 122 is identical. Sidewall 122 has an upper edge with a curved portion defining a tab 138 and a sloped portion defining a ramp-supporting surface 140. Tab 138 is configured for reception through a slot 132 of ramp 112 to define guide walls 126 (FIGS. 2, 3). Ramp 112 rests against the ramp-supporting surface 140 of both sidewalls 122 and is secured by the reception of each sidewall's tab 138 through slots 132. Accordingly, ramp-supporting surface 140 is angled to provide the desired orientation of ramp 112.

Sidewall 122 has a lower edge contoured to define a plurality of tabs 144. Tabs 144 are configured for reception by mounting slots 134 in grate 114. Tabs 144 have notches 146 to engage grate 114 and secure sidewall 122 thereto when tabs 144 are inserted through slots 134. The lower edge of sidewall 122 is contoured to define a gap between tabs 144. When tabs 144 are received in slots 134 of grate 114, the gaps define openings 124 (see FIG. 3).

Joints between sidewalls 122 and ramp 112 and grate 114 may be reinforced using adhesives or by welding. In some embodiments, struts 150 may be provided to reinforce any ramp 112, grate 114 and sidewalls 122 (see FIG. 2). In such embodiments, sidewalls 122 may have slots 152 to receive struts 150.

Sidewalls 122 may also have slots 148 for receiving lip 116 and deflector 120, respectively.

Ramp 112 and grate 114 are mounted to a post 117, best shown in FIGS. 2-3. Post 117 may be formed, for example, from metal such as steel or aluminium or from plastic, such as pultruded fiber-reinforced plastic. As depicted, post 117 has telescoping upper and lower sections 117*a*, 117*b*. In other embodiments, post 117 may have additional telescoping sections. Ramp 112 and grate 114 are fixed, for example, by welding or using fasteners, to upper post section 117*a*. Lower post section 117*b* rests on the bottom of sump 106 of the catch basin 102. As noted above, flaps 130 loosely engage catch basin walls 103 to support insert 100. Thus, flaps 130 and post 117 cooperate to hold insert 100 generally upright within the catch basin 102. The height of insert 100 determines the elevation of ramp 112 and grate 114 in relation to sump 106 (alternatively, below grate 108). The height can be adjusted by extending or retracting post 117. Post 117 has a locking mechanism, such as a pin or bolt and a series of mating holes on upper and lower sections 117*a*, 117*b* to lock insert 100 at a desired height. Post 117 has an eyelet 160 proximate its upper end. Post 117 may be gripped and manipulated by inserting a tool through eyelet 160.

Insert 100 may preferably be installed in catch basin 102 so that grate 114 is positioned just above the expected fluid level in sump 106, typically, the lower edge of outlet 110. However, in some embodiments, grate 114 may alternatively be positioned as much as 15 cm above or below the bottom of outlet 110. With grate 114 positioned in this manner, small or slow fluid flows may flow over insert 100, land on grate 114, and enter the sump 106 through openings 118 and through notches 128. In contrast, large or fast fluid flows may tend to flow across grate 114. Thus, positioning grate 114 allows small flows to enter the sump with relatively little disturbance of pool P, but tends to separate fast flows, limiting mixing with (and thus, churning of) pool P.

The combination of extendible post 117 and flaps 130 may allow for relatively easy installation of insert 100 in a wide range of catch basins. For example, the adjustable height of post 117 may enable insert 100 to be installed in a manner suitable for shallow or deep catch basins or catch basins expected to see a range of flow conditions. Flaps 130 may allow insert 100 to be installed in catch basins having a range of widths. That is, flaps 130 may be able to engage and support insert 100 in a basin somewhat larger or smaller than a particular nominal size. In a smaller catch basin, flaps 130 will deflect and fit relatively tightly, while in a larger catch basin, flaps 130 will deflect less and engage the walls relatively loosely, but may still be capable of supporting insert 100.

Insert 100 is installed by adjusting post 117 to position grate 114 at approximately the same height as the bottom of outlet 110. As noted, the bottom of outlet 110 is typically the expected height of fluid in sump 106 under normal conditions. Accordingly, grate 114 is likewise positioned just above the expected fluid level. Grate 108 is then removed and insert 100 is placed in catch basin 102 with post 117 resting on the bottom of sump 106 and with at least some of flaps 130 resting against walls 103 such that insert 110 is held generally upright by the combined support of post 117 and flaps 130. Insert 100 may be lowered into place using a tool such as a hook or a looped rope or chain inserted in eyelet 160.

Thus, installation of insert 100 does not require any fasteners or fastening tools. Accordingly, insert 100 may be installed relatively quickly and easily. Similarly, insert 100 may be removed from a catch basin relatively quickly and easily, by simply inserting a tool in eyelet 160 and pulling the insert up out of the catch basin. This may provide for relatively easy servicing. For example, an insert 100 could be quickly removed to pump other otherwise remove accumulated sediment, or to replace or repair the insert.

Figure 7:
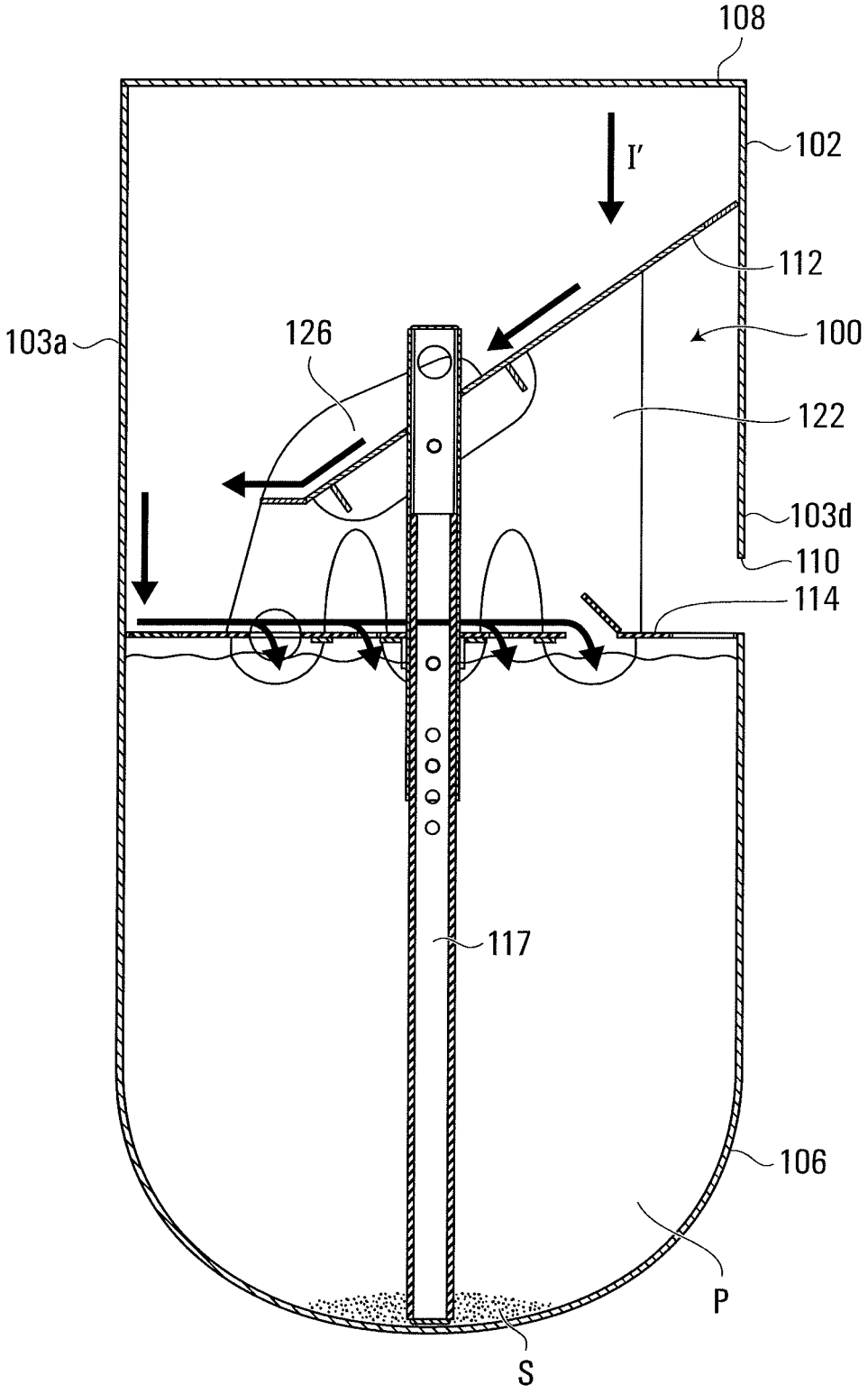
FIG. 7 is a diagram of a first fluid flow path around the insert of FIG. 2.

FIG. 7 depicts a side cross-sectional view of catch basin 102 with insert 100 installed. Arrows I' denote a primary example path of fluid over and through insert 100, typical of small flows.

Some inflowing fluid lands on and runs along ramp 112. Ramp 112 directs fluid downwardly and toward front wall 103*a* (i.e., away from outlet 110).

At the bottom edge of ramp 112, fluid flows over lip 116, which deflects the fluid path upwardly. After leaving lip 116, some fluid with relatively high velocity may hit front wall 103*a* and then fall onto grate 114. Fluid leaving lip 116 with lower velocity may simply fall onto grate 114.

After falling onto grate 114, either directly from ramp 112 or from wall 103*a*, fluid flows across grate 114. Fluid may communicate between grate 114 and sump 106 through openings 118 and through notches 128. Sediment in the incoming fluid may be settled into sump 106. Fluid flowing over grate 114 may generally flow towards rear wall 103*d* on which outlet 110 is positioned. Some fluid may reach deflector 120 and, upon hitting deflector 120, the fluid may be slowed or stopped or the direction of flow may be turned away from outlet 110.

Energy is dissipated as fluid flows in a tortuous path over insert 100. Specifically, energy is dissipated each time the direction of flow is changed. For example, a stream of fluid may be redirected upon landing on ramp 112, upon hitting lip 116, upon hitting wall 103*a*, upon landing on grate 114, and upon hitting deflector 120. Energy is also lost to friction as fluid flows across surfaces. For example, energy is lost to friction as fluid flows across ramp 112 and grate 114, across lip 116, and down wall 103*a*.

As a result, fluid flowing across, around and through insert 100 is likely to have a relatively low velocity upon reaching pool P, and ultimately, upon reaching outlet 110.

As noted, fluid flowing into pool P with high velocity may cause churning of the pool and mixing of dirt and sediment. Mixed dirt and sediment may then be carried out of catch basin 102 by fluid flowing out through outlet 110. Conversely, fluid that flows into pool P at low velocity is less likely to cause churning in the pool and mixing of dirt and sediment, which may ultimately reduce the amount of dirt and sediment carried out of catch basin 102 by outflowing fluid.

In certain circumstances, the flow rate of incoming fluid may be much higher than normal. Such circumstances may occur, for example, in the case of flooding, sustained heavy precipitation, severe seasonal melting events, and the like.

Figure 8:
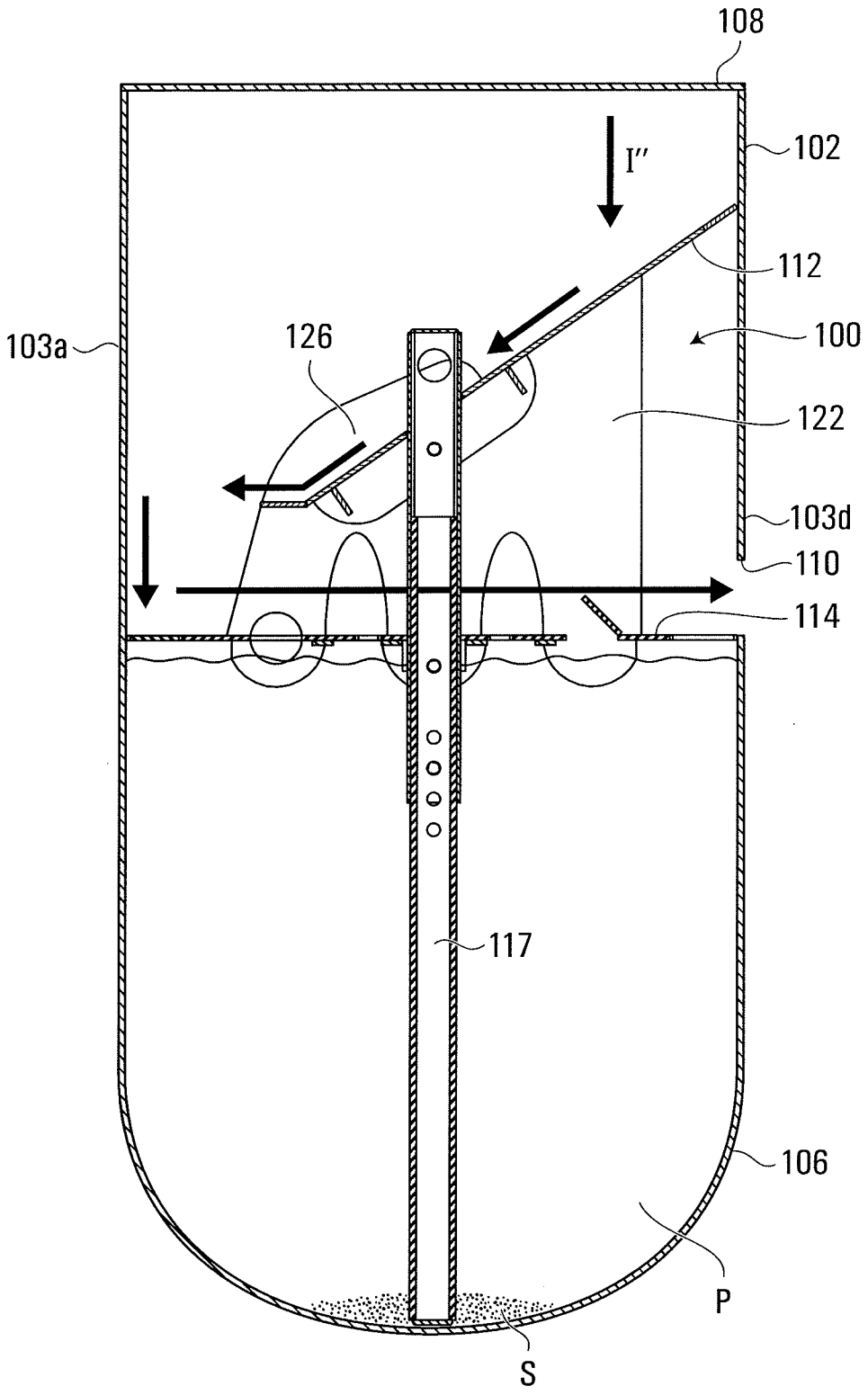
FIG. 8 is a diagram of a second fluid flow path around the insert of FIG. 2.

FIG. 8 again depicts a side cross-sectional view of catch basin 102 with insert 100. Arrows I" denote a secondary example path of fluid over and through insert 100, typical of large or very high-velocity flows.

As is the case with small flows, some inflowing fluid lands on and runs along ramp 112, which directs fluid downwardly and toward front wall 103*a* (i.e., away from outlet 110). Fluid then flows over lip 116 and is deflected upwardly to either hit wall 103*a* and fall onto grate 114, or fall directly onto grate 114.

Wall 103*a* and grate 114 then divert or reverse the fluid flow back towards outlet 110. Large or very fast flows tend to rush across grate 114, with relatively little fluid communicating through openings 118, 128. In effect, grate 114 at least partially separates the fast-flowing incoming fluid of a large flow from the relatively still fluid previously accumulated in sump 106. As will be apparent, this limits mixing of the inflowing fluid with the sump fluid, and likewise limits churning of the sump fluid. Accordingly, separating large flows from fluid in sump 106 may reduce the likelihood of sediment in the sump being mixed with the flows and carried out of the catch basin 102 through outlet 110.

Grate 114 effectively defines a barrier over sump 106. Small, slow flows may be permitted to enter sump 106 through openings for settling and retention of sediment, while flows that are too large or too fast for effective settling may be partially or fully segregated from fluid in sump 106. Instead, large flows may be conveyed to outlet 110 so that scour or churn of previously-captured sediment is avoided and such sediment is retained in sump 106.

Catch basin 102 may have a certain maximum throughput, defined as the maximum rate at which fluid can flow therethrough in the absence of insert 100. The maximum throughput (also referred to as hydraulic capacity) may be a function of the size of outlet 110. Decreasing the rate at which fluid can flow through catch basin 102 could cause choking of inlet section 104, which could itself lead to backup and flooding at the ground surface near the inlet of catch basin 102.

As previously noted, insert 100 is configured to partially, rather than fully occlude catch basin 102. Significant gaps exist between lip 116 and wall 103*a* and between ramp 112 and grate 114 so that flow around lip 116 and across grate 114 toward rear wall 103*d* is not restricted, even when flow rate is very high. Specifically, the gap between lip 116 and front wall 103*a* and the gap between grate 114 and ramp 112 have sufficiently large cross-sectional area to permit at least the same flow rate as outlet 110, so that the placement of insert 100 does not significantly reduce the hydraulic capacity (i.e. maximum throughput) of catch basin 102.

Figure 9:
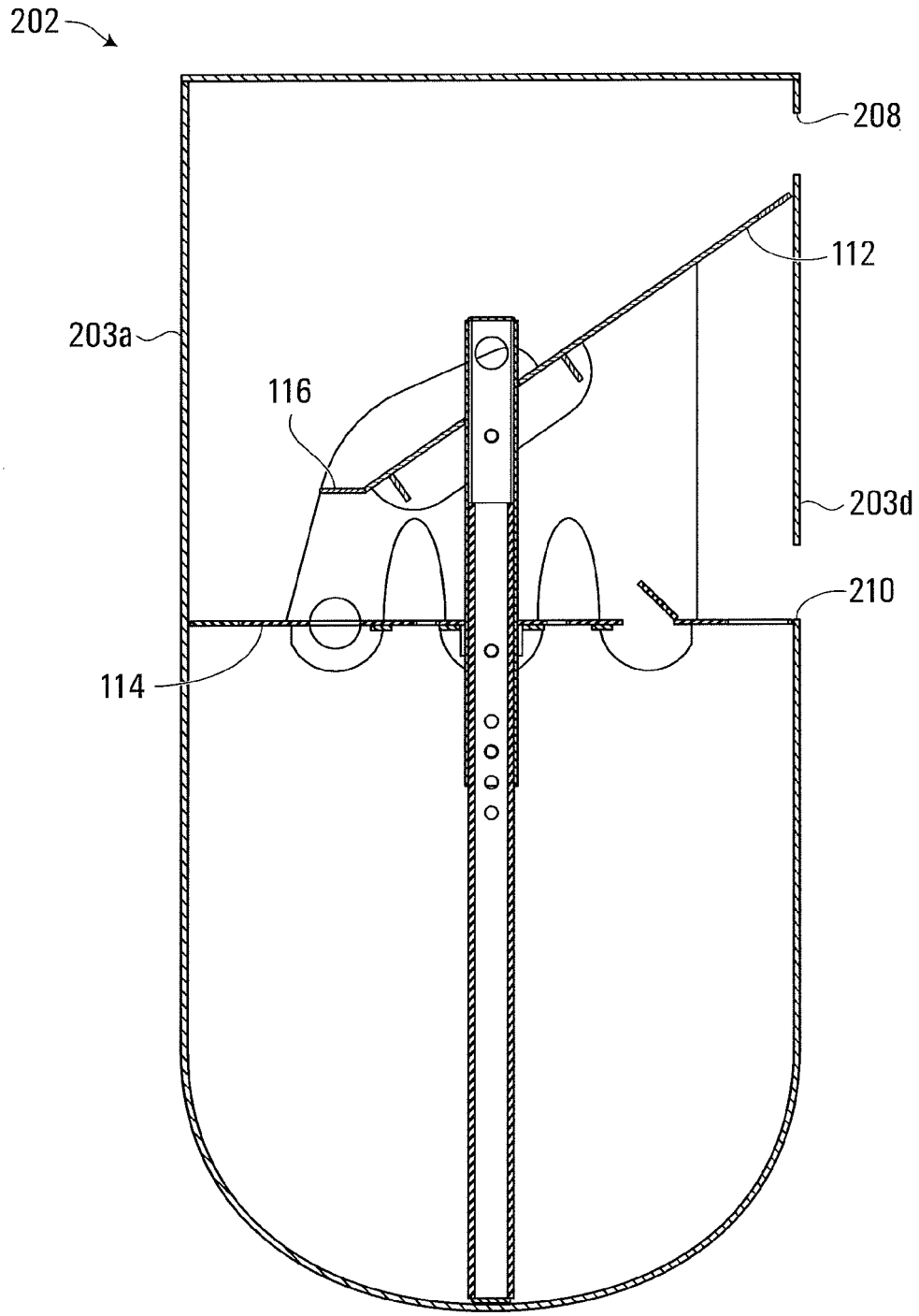
FIG. 9 is a cross-sectional view of the insert of FIG. 2 in another catch basin.

Insert 100 may alternatively be installed in a catch basin having a side inlet. For example, FIG. 9 depicts insert 100 installed in a catch basin 202. Catch basin 202 has an inlet 208 in front wall 203*a* and an outlet 210 in a lower portion of rear wall 203*d*, above a sump 206. For illustrative purposes, inlet 208 is positioned near the top of wall 203*a*, however, inlet 208 may be positioned anywhere above outlet 210. Ramp 112 is positioned below inlet 208 so that flow from inlet 208 is discharged onto ramp 112. Ramp 112 then directs fluid down to lip 116 and toward front wall 203*a*, after which fluid falls on grate 114 and flows therethrough as described above.

As described above, ramp 112 is a solid plate. However, in other embodiments, ramp 112 may have perforations or openings to allow fluid to fall through ramp 112 and onto grate 114.

In some embodiments, ramp 112 may have a roughened surface to increase drag on fluid flowing over ramp 112 and thus further decelerate the fluid.

Other possible modifications will be apparent to skilled persons in view of the disclosure herein. Accordingly, the invention is defined by the claims.

What is claimed:

1. A baffle insert for a catch basin with a sump, a plurality of walls defining a passage to said sump, and an outlet, the insert comprising:

a downwardly-sloping ramp for positioning in said passage to partially occlude said passage with a lower edge of said ramp proximate a first one of said walls and direct inflowing fluid toward said first wall;

a grate positioned below said ramp to intercept fluid falling from said ramp and direct said falling fluid toward said outlet, said grate having a plurality of apertures for permitting fluid to communicate with said sump therethrough;

said ramp and said grate mounted to a post for supporting said ramp and said grate by resting said post on the bottom of said sump, said post extendible to adjust the heights of said ramp and said grate above said sump.

2. The baffle insert of claim 1, wherein said apertures are each between 25 mm and 50 mm wide in a primary direction of flow of said fluid.

3. The baffle insert of claim 1, wherein said apertures occupy between 15% and 50% of the area of said grate.

4. The baffle insert of claim 1, wherein said outlet is in a second wall, opposite said first wall, and wherein said post is extendible to position said grate substantially at the height of the lower edge of said outlet.

5. The baffle insert of claim 4, wherein said post is extendible to position said grate between 15 cm below and 15 cm above said outlet.

6. The baffle insert of claim 1, further comprising a plurality of guide walls extending upwardly from a surface of said ramp, said guide walls positioned to direct fluid along the length of said ramp.

7. The baffle insert of claim 1, further comprising at least one resilient support member extending from said ramp or said grate to support said insert against a wall of said plurality of walls.

8. The baffle insert of claim 1, wherein said ramp is positioned at an angle of between 5 degrees and 60 degrees from horizontal.

9. The baffle insert of claim 8, further comprising a lip extending toward said wall from a lower edge of said ramp, said lip angled upwardly relative to said ramp.

10. The baffle insert of claim 9, wherein said lip is upwardly angled by between zero degrees and 90 degrees relative to said ramp.

11. A baffle insert for a catch basin having a sump, a passage to said sump, and an outlet, said baffle insert comprising:

a downwardly sloping ramp;

a grate below said ramp, the grate having at least one aperture therethrough;

an extendible post for resting on a bottom wall of said catch basin to support said ramp and said grate at a desired height above said sump such that inflowing fluid is intercepted by said ramp, and fluid falling from said ramp lands on said grate and is directed toward said outlet, wherein said fluid is decelerated to promote settling of sediment and said grate permits communication of fluid into said sump through said apertures.

12. The baffle insert of claim 11, wherein said apertures are each between 25 mm and 50 mm wide in a primary direction of flow of said fluid.

13. The baffle insert of claim 11, wherein said apertures occupy between 15% and 50% of the area of said grate.

14. The baffle insert of claim 11, wherein said ramp is configured to direct inflowing fluid toward a first wall of said catch basin, opposite a second wall having said outlet.

15. The baffle insert of claim 11, further comprising a plurality of guide walls extending upwardly from a surface of said ramp, said guide walls positioned to direct fluid toward a lower edge of said ramp.

16. The baffle insert of claim 11, further comprising at least one resilient support member extending from said ramp or said grate to support said baffle insert against a wall of said catch basin.

17. The baffle insert of claim 11, wherein said ramp is positioned at an angle of between 5 degrees and 60 degrees from horizontal.

18. The baffle insert of claim 17, further comprising a lip extending from a lower edge of said ramp, said lip angled upwardly relative to said ramp.

19. The baffle insert of claim 18, wherein said lip is upwardly angled by between zero degrees and 90 degrees from said ramp.

20. A baffle insert for a catch basin with a sump, a plurality of walls defining a passage to said sump, and an outlet, the baffle insert comprising:

a ramp in said passage below an inlet of said catch basin, said ramp positioned to catch fluid flowing through said inlet and direct said fluid downwardly and toward a first wall of said catch basin;

a grate below said ramp in said passage, said grate abutting said first wall and positioned to catch fluid falling from said ramp and direct said fluid toward said outlet, said grate having a plurality of apertures for permitting fluid to communicate with said sump therethrough;

a post resting on the bottom of said sump, said post supporting said ramp and said grate.

21. A method of controlling fluid flow in a catch basin, comprising:

installing an insert having a ramp and a grate in a catch basin, said installing comprising adjusting a height of a support post to position said grate at a desired height above a sump of said catch basin;

directing inflowing fluid toward a wall of said catch basin with said ramp, thereby decelerating said fluid;

intercepting fluid falling from said ramp and diverting said fluid toward an outlet of said catch basin with a grate to further decelerate said fluid;

directing fluid through apertures in said grate into a sump of said catch basin for settling of sediment in said sump.

* * * * *